United States Patent [19]

Bailey

[11] 4,085,722

[45] Apr. 25, 1978

[54] DISTRIBUTOR TYPE FUEL PUMP

[75] Inventor: John M. Bailey, Dunlap, Ill.

[73] Assignee: Caterpillar Tractor Co., Peoria, Ill.

[21] Appl. No.: 728,471

[22] Filed: Oct. 1, 1976

[51] Int. Cl.[2] ..... F02M 49/00; F04B 19/22

[52] U.S. Cl. ..... 123/139 AL; 123/139 AN; 123/139 AP; 123/139 BC; 417/462

[58] Field of Search ..... 123/139 AL, 139 AN, 123/139 AP, 139 AQ, 139 BE, 139 BC; 417/253, 273, 462

[56] References Cited

U.S. PATENT DOCUMENTS

| | | | |
|---|---|---|---|
| 2,291,939 | 8/1942 | Amery | 123/137 AL |
| 2,381,585 | 8/1945 | Gambrell | 123/139 AL |
| 2,474,396 | 6/1949 | Groves | 123/139 AL |
| 2,522,890 | 9/1950 | Peterson | 123/139 AL |
| 3,323,506 | 6/1967 | Pigeroulet et al. | 123/139 AL |
| 3,485,225 | 12/1969 | Bailey et al. | 123/139 AL |
| 3,673,996 | 7/1972 | Dreisin | 123/139 AP |
| 3,797,469 | 3/1974 | Kobayashi et al. | 123/139 E |

*Primary Examiner*—Charles J. Myhre
*Assistant Examiner*—Parshtam S. Lall
*Attorney, Agent, or Firm*—Phillips, Moore, Weissenberger, Lempio & Majestic

[57] ABSTRACT

A small, high-speed distributor type fuel pump for use with internal combustion engines is provided. The pump includes a pair of opposed pistons driven by an eccentric on a drive shaft. Means are provided for varying both the volumetric flow as well as timing. Variable timing means are in the form of helically shaped splines on a layshaft, which layshaft is actuatable by means to adjust relative positions of gears in a gear train interconnecting the drive shaft and a distributor rotor. Volumetric flow variation is achieved by change in the axial position of the distributor rotor.

8 Claims, 5 Drawing Figures

FIG _ 1
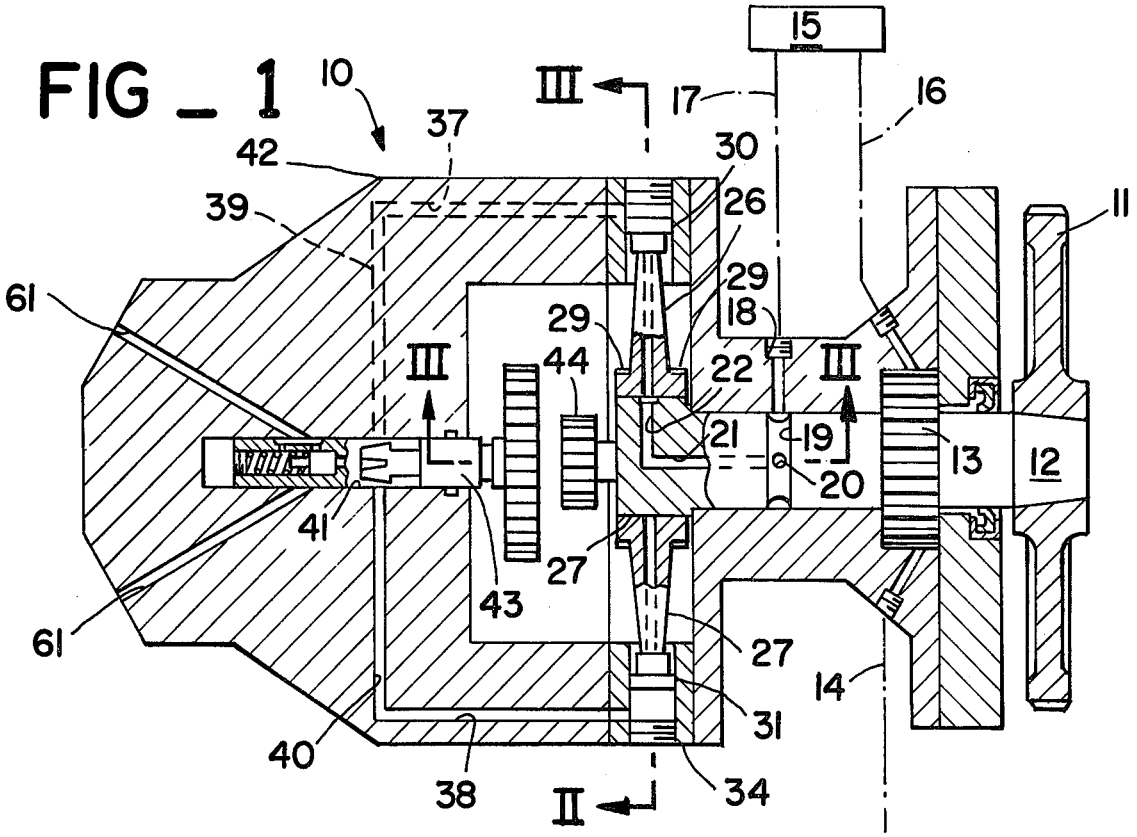
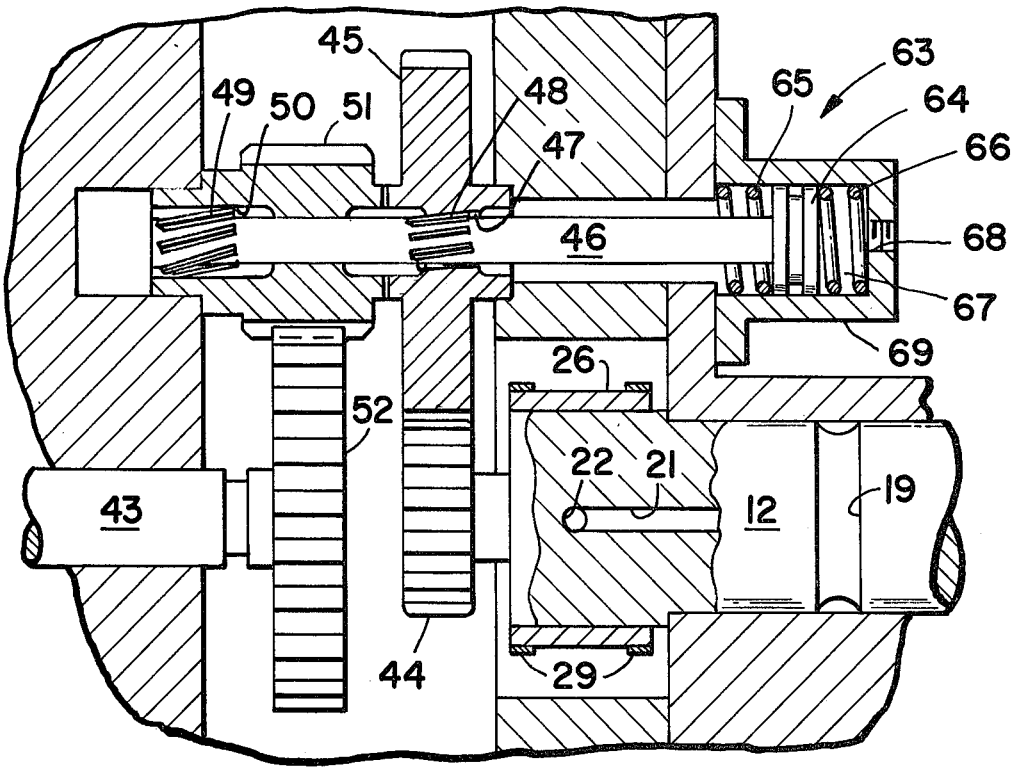
FIG _ 3

DISTRIBUTOR TYPE FUEL PUMP

BACKGROUND OF THE INVENTION

This invention relates to a distributor type fuel pump having a pair of opposed reciprocating pistons which feed a rotor for a metering, distributing and timing fuel delivery to an engine.

Currently, a large number of distributor type fuel pumps exist which are useful in combination with internal combustion engines for distributing fuel to the cylinders thereof. Examples of such prior art pumps are shown in Bailey et al, U.S. Pat. No. 3,485,225 and Kobayashi et al, U.S. Pat. No. 3,797,469. These prior art distributor type fuel pumps, however, are rather complex and costly. The complexity and cost is generally due to the fact that these and other prior art pumps require many closely fit moving parts which must be manufactured to very high tolerances. Complexity is also engendered by the difficult timing mechanisms that are used with such prior art distributor type fuel pumps. Fuel quantities are limited by ability to fill the pump cavity at the higher frequency pumping strokes required. Fuel quantities and pressures are limited by the camshafts employed.

SUMMARY AND OBJECTS OF THE INVENTION

It is, therefore, the primary object of this invention to provide a rotary distributor type fuel injection pump which reduces the cost over presently existing prior art structures, while at the same time gaining performance and reducing wear.

It is a further object of this invention to provide an improved distributor type pump of simple construction and therefore of lower cost.

It is a further object of this invention to provide a distributor type fuel pump having the capability of closely controlling a metering volumetric fuel rate, as well as injection timing.

It is a further object of this invention to provide such a pump having high capacity for its size in comparison with the prior art pumps through use of hydrodynamic bearings to actuate the pump plungers instead of the conventional load limited cams.

It is a still further object of this invention to provide a distributor type fuel pump of high speed capability to eliminate the need for complex governor structures while providing improved metering of fluid.

In achieving the above objectives, the instant invention includes a distributor type fuel pump comprising a housing having a plurality of passages therein adapted for connection to a plurality of cylinders of, for example, an internal combustion engine. A first bore in the housing has a rotatable shaft received therein which is driven by a drive gear on one end thereof. The opposite end thereof includes an eccentric for driving oppositely mounted pistons which reciprocate in similarly situated bores. Fluid is pumped from a fluid pressure source through internal passages in the shaft and thence through an arcuate slot in the eccentric portion of the shaft alternatively to the piston cylinders. From the cylinders fuel is directed through passages in the housing to a distributor rotor having scrolls thereon for distribution to the various plurality of passages intercommunicating with the cylinders. The rotor is movable both axially as well as rotatively so as to meter the proper amount of fuel into each of the plurality of passages.

Metering and timing are accomplished by means of an axially movable layshaft having helical splines thereon and movable by means of a hydraulically or pneumatically actuated piston on one end thereof. The layshaft supports a pair of gears of a gear train interconnecting the drive shaft with the distributor rotor. By pneumatic or hydraulic actuation of the layshaft in the axial direction, relative positioning of the rotor with respect to the drive shaft is accomplished through the helical spline arrangement whereby timing is adjusted.

Further and other objects of this invention will become more readily apparent from a review of the following description and attached drawings.

BRIEF DESCRIPTION OF THE DRAWINGS

FIG. 1 is a longitudinal cross-sectional view taken through a complete pump of the instant invention, illustrating the major components thereof, as well as their general relationship;

FIG. 3 is a cross-sectional view taken along lines III—III, rotated 90° for purposes of clarity;

DETAILED DESCRIPTION

Figure 2:
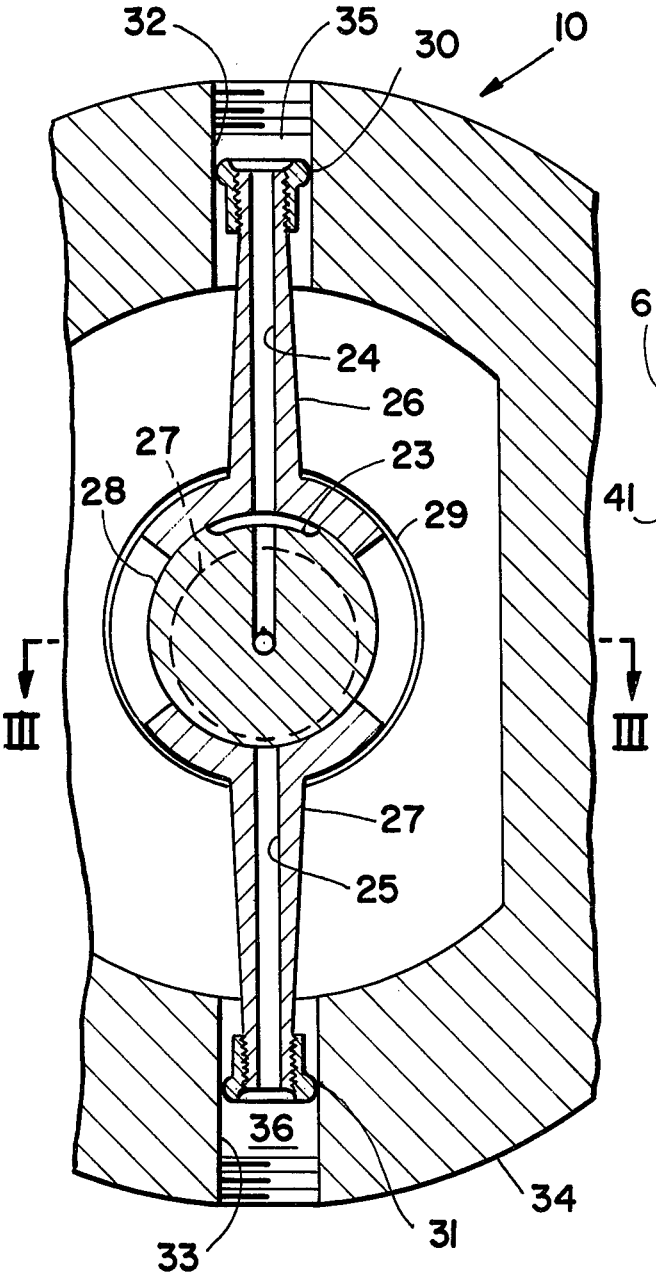
FIG. 2 is a cross-sectional view taken along lines II—II of FIG. 1, illustrating details of the pumping structure.

Turning to FIG. 1, a distributor type pump shown generally at 10 has a drive gear 11 secured to a drive shaft 12 of the pump. Drive gear 11 is driven by the engine gear train (not shown) and in turn rotates shaft 12 and thereby the distributor pump. A gear type fluid pump 13 mounted on and driven by shaft 12 pumps fluid such as fuel from a line 14 to and from a filter 15 by means of lines 16, 17 where it is delivered to a passage 18 communicating with an annular groove 19 in shaft 12.

Passages 20, 21 and 22 communicate between annular groove 19 and an arcuate slot 23 to deliver fuel at predetermined intervals to passages 24 and 25 of pumping rods 26 and 27 as best seen in FIG. 2.

The pumping rods are driven by an eccentric 28 of shaft 12 and are held in sliding engagement with the eccentric by use of retaining springs 29. Pumping rods 26 and 27 have pistons 30 and 31 secured to their distal ends which reciprocate within bores 32 and 33 of a pumping plate 34. Chambers 35 and 36 within plate 33 are intersected by passages 37 and 38 respectively and communicate with passages 39 and 40, as best seen in FIG. 1. An axial bore 41 within a housing 42 is intersected by passages 39 and 40 and has a rotor 43 slidably and rotatably disposed therein.

Referring to FIGS. 1 and 3, a first gear 44 of shaft 12 engages a second gear 45 disposed on a layshaft 46 having internal helical splines 47 engaging accommodatingly shaped external splines 48 on the shaft. A second set of helical splines 49 on one end of shaft 46 engage splines 50 of a third gear 51 wich in turn drives a gear 52 secured to rotor 43.

Fluid such as fuel is pumped from a fluid source (not shown) by pump 13 through filter 15. The fluid from filter 15 is delivered to passages 20, 21 and 22 against slot 23 which permits fuel to be delivered to the pumping rods 26 and 27 during the pumping load of each rod. When rod 26 is urged towards the pumping mode the fluid pressure in chamber 35 is increased and a fluid flow takes place in passages 37 and 39. Because rod 27 is in a suction mode, fluid flow from passage 39 will continue to passages 40 and 38 to chamber 36. As the eccentric 28 rotates it urges rod 27 into a pumping mode and rod 26 is brought to a suction mode, thereby reversing fluid circulation. The arcuate end of rods 26 and 27 float on a hydrodynamic oil film formed between the rods and eccentric 28. This arrangement is capable of sustaining much higher loads then the conventional roller cam and thus the pump is capable of much greater output than distributor pumps of the prior art.

Figure 4:
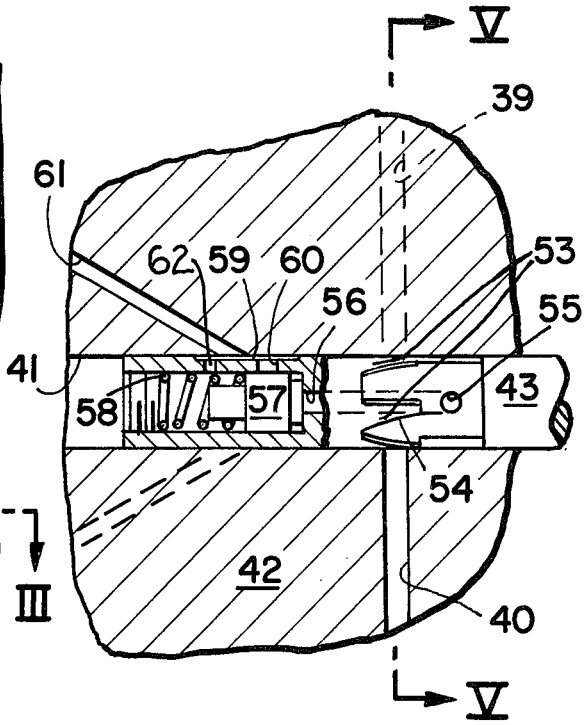
FIG. 4 is a side cross-sectional elevation view of the rotor of the instant invention, illustrating the scrolls thereon; and, FIG. 5 is a cross-sectional elevation view taken along lines V—V in FIG. 4, illustrating further details of the rotor.
Figure 5:
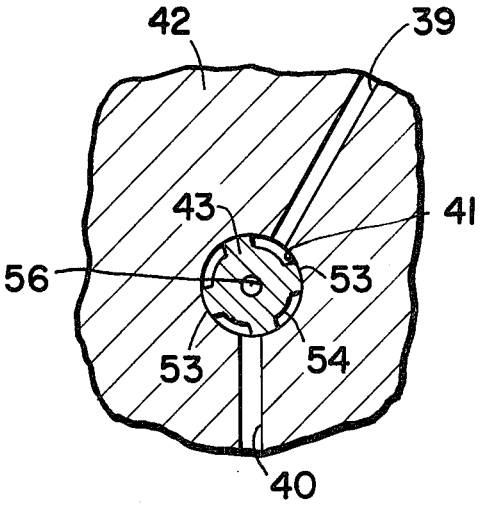

As best seen in FIGS. 4 and 5, rotor 43 which intersects passages 39 and 40 at bore 41 has a plurality of scrolls 53 formed on its outer surface with grooves 54 interposed between each scroll. The scrolls provide an interruption to fluid flow between passages 39 and 40 to provide injection in the following manner. When passage 40 is blocked by a scroll and passage 39 is open to a groove 54, there is an increase in fluid pressure causing fluid to flow through a passage 55 and 56 to urge a skirted valve piston 57 to move to the left as viewed in FIG. 4 to an open position against the bias of spring 58, allowing pressure fluid to enter into an axially disposed slot 59 by means of a passage 60. At this time slot 59 is alinged with a passage 61 in body 42, thus a pressure fluid is permitted to communicate between the passage 61 and an injection nozzle (not shown) within an engine cylinder through suitable tubing (not shown). There are a plurality of passages 61 provided dependent upon the number of cylinders in the engine.

As rotor 43 rotates further passage 39 is blocked and passage 40 is opened, thus ending injection. A leak-off hole 62 in valve 43 may be provided to prevent hydraulic lock behind valve 57.

In operation, the amount of fuel injected into each cylinder is determined by the period of time a scroll with block either passage 39 or passage 40. Because the scrolls are tapered, axial movement of rotor 43 in a leftward direction, as viewed in the figures, causes less fuel or fluid to be injected until shutoff occurs. Rightward movement of rotor 43 permits more fuel to be injected because of the longer time the scroll spends blocking either passage 39 or passage 40.

Timing of the fuel pump is achieved in the following manner. Referring again to FIG. 3, the end of layshaft 46 opposite to the spline end extends beyond gears 51 and 45 to engage a pneumatically or hydraulically actuated timing mechanism shown generally at 63. The drawing shows a simplified mechanism wherein a piston 64 balanced by spring 65 and 66 may be moved in one direction with an increase in pressure within a chamber 67 to move shaft 46 in a leftward direction. Such pressure may be conveyed from a fluid pressure source (not shown) through a passage 68 in the end of a housing 69 containing the piston. The helical splines 47, 48, 49 and 50 would thus change the annular relationship of the gears with regard to the position of the engine crank, thus effecting a change in timing with the rotor 43 which controls the injection period. With a decrease in pressure in chamber 67, spring 65 will move piston 64 and thereby layshaft 46 to the right as viewed in the figures, resulting in a reverse change in the timing.

It is to be understood that the foregoing description is merely illustrative of a preferred embodiment of the invention, and that the scope of the invention is not to be limited thereto, but is to be determined by the scope of the appended claims.

What is claimed is:

1. A distributor type fluid pump comprising:

a housing having a plurality of passages adapted for connection to a plurality of cylinders;

a first bore in said housing defining a first, longitudinal axis;

a rotatable shaft received in said first bore;

a second bore in said housing defining a second, longitudinal axis;

a rotor mounted in said second bore for both reciprocating and rotating movement;

pump means connected to said shaft for providing fluid under pressure, said pump means comprising:

an eccentric on said rotatable shaft, a pair of oppositely directed pump rods each having an end rotatably mounted on said eccentric, a piston mounted on a free end of each said rod, each said piston being slidably received in a bore defining a chamber with said housing, a passage in each said pump rod intercommunicating the piston end with the end rotatably mounted on the eccentric, an arcuate slot in said eccentric, passage means in said shaft intercommunicating said slot with a source of fluid whereby rotation of said shaft causes fluid to be alternately communicated to each said chamber so as to supply said rotor with fluid;

first passage means in said housing communicating each said chamber with said rotor so as to provide pressure fluid thereto;

scroll means on said rotor for directing and metering fluid alternately to each one of said plurality of passages depending upon the rotational position of said rotor; and, timing means interconnecting said rotatable shaft with said rotor for changing the rotative position of said shaft with respect to said rotor whereby timing of said pump may be adjusted.

2. The invention of claim 1 wherein said pump means further comprises a gear pump mounted on said shaft intercommunicating and directing fluid from said source of fluid pressure to said pump means.

3. The invention of claim 1 wherein said first axis is concentric with said second axis whereby said rotatable shaft is aligned with said rotor.

4. A distributor type fluid pump comprising:

a housing having a plurality of passages adapted for connection to a plurality of cylinders;

a first bore in said housing defining a first, longitudinal axis;

a rotatable shaft received in said first bore;

a second bore in said housing defining a second, longitudinal axis;

a rotor mounted in said second bore for both reciprocating and rotating movement;

pump means connected to said shaft for providing fluid under pressure;

first passage means in said housing communicating said pump means with said rotor so as to provide pressure fluid thereto;

scroll means on said rotor for directing and metering fluid alternately to each one of said plurality of passages depending upon the rotational position of said rotor, and, timing means comprising a layshaft rotatably mounted in said housing and interconnecting gears on said rotor, rotating shaft and layshaft, said timing means interconnecting said rotatable shaft with said rotor for changing the rotative position of said shaft with respect to said rotor whereby timing of said pump may be adjusted.

5. The invention of claim 4 wherein said timing means further comprises helical splines and grooves on said layshaft and on said gears mounted thereon, whereby axial movement of said layshaft causes relatively rotational adjustment between said gears mounted thereon and said layshaft, and means for selectively, axially moving said layshaft whereby said rotational adjustment is accomplished.

6. The invention of claim 5 wherein said means for axially adjusting said layshaft comprises a piston mounted on one end thereof for moving said layshaft in one direction in response to fluid pressure directed thereto, and spring biasing means for directing said layshaft in a direction opposite to said one direction.

7. The invention of claim 5 wherein said scroll means comprises scrolls positioned around said rotor, and wherein said rotor further includes spring biased valve means therein and passage means in said rotor intercommunicationg said scrolls with said plurality of passages through said valve means.

8. A distributor type fluid pump comprising:

a housing having a plurality of passages adapted for connection to a plurality of cylinders;

a first bore in said housing defining a first, longitudinal axis;

a rotatable shaft received in said first bore;

a second bore in said housing defining a second, longitudinal axis;

a rotor mounted in said second bore for both reciprocating and rotating movement;

pump means connected to said shaft for providing fluid under pressure, said pump means comprising:

an eccentric on said rotatable shaft, a pair of oppositely directed pump rods each having an end rotatably mounted on said eccentric, a piston mounted on a free end of each said rod, each said piston being slidably received in a bore defining a chamber with said housing, a passage in each said pump rod intercommunicating the piston end with the end rotatably mounted on the eccentric, an arcuate slot in said eccentric, passage means in said shaft intercommunicating said slot with a source of fluid whereby rotation of said shaft causes fluid to be alternately communicated to each said chamber so as to supply said rotor with fluid, first passage means in said housing communicating each said chamber with said rotor so as to provide pressure fluid thereto;

scroll means on said rotor for directing and metering fluid alternately to each one of said plurality of passages depending upon the rotational position of said rotor;

said scroll means comprising scrolls positioned around said rotor, and wherein said rotor further includes spring biased valve means therein and passage means in said rotor intercommunicating said scrolls with said plurality of passages through said valve means.

* * * * *